United States Patent [19]

Kelly

[11] 4,441,295

[45] Apr. 10, 1984

[54] GRID SYSTEM ADHERING TECHNIQUE AND METHOD OF PRACTICING SAME

[76] Inventor: Thomas L. Kelly, 31 Sands St., Waterbury, Conn. 06723

[21] Appl. No.: 259,200

[22] Filed: Apr. 30, 1981

[51] Int. Cl.[3] ..... E04B 5/00

[52] U.S. Cl. ..... 52/408; 52/309.8; 52/410; 52/746

[58] Field of Search ..... 52/404, 410, 408, 409, 52/746, 309.8, 309.9; 156/71, 290, 291

[56] References Cited

U.S. PATENT DOCUMENTS

| | | | |
|---|---|---|---|
| 3,763,614 | 10/1973 | Hyde et al. | 52/408 X |
| 4,259,817 | 4/1981 | Elliot | 52/404 X |
| 4,374,687 | 5/1983 | Yamamoto | 156/71 |

FOREIGN PATENT DOCUMENTS

| | | | |
|---|---|---|---|
| 886616 | 1/1962 | United Kingdom | 52/410 |

*Primary Examiner*—Carl D. Friedman

*Attorney, Agent, or Firm*—Hayes & Reinsmith

[57] ABSTRACT

A roofing installation is disclosed having a unique construction particularly suited for minimizing certain major costs and labor relating to roof installation. A plurality of substrates are provided including a deck and a course of insulation blocks supported by the deck. An upper roof surface is provided by a flexible sheet membrane secured to a substrate underlying the membrane. Adhesive means are applied in a predetermined pattern to provide adhesively sealed areas between the flexible membrane and its underlying substrate while additionally providing selected zones between the membrane and its underlying substrate completely free of adhesive means. The adhesively sealed areas are in overlying, lapping relation to the perimeters of the insulation blocks to provide a roofing seal of high integrity which minimizes undesired air infiltration through joints between abutting insulation blocks and any apertures or holes created by fastener installation for securing roof substrates to the roof deck.

17 Claims, 6 Drawing Figures

GRID SYSTEM ADHERING TECHNIQUE AND METHOD OF PRACTICING SAME

BRIEF SUMMARY OF THE INVENTION

This invention has been designed for use in a roofing installation with the special thought in mind of significantly saving on the amount of expensive adhesive normally used to secure an upper flexible sheet membrane to one of the substrates of the roofing installation. It has been my experience in the roofing trade that if the precepts of this disclosure are followed, the flexible membrane will adhere to an underlying substrate of the roofing installation in a firm and sound manner while significant economies are realized in substantial reductions in the amount of the adhesive normally necessary to provide firm and reliable adherence of the flexible membrane to the underlying substrate of the roofing installation.

It is a further characteristic of this invention that it produces an assembly which may eliminate nailing and mechanical fasteners for the flexible membrane and this is a distinct advantage due to the fact that, if such nailing and mechanical fasteners are used, one must normally resort to reflashing. Thus, the principle taught by this roofing installation permits the flexible sheet membrane to function as its own flashing or as an upwall waterproofing element, e.g., about protrusions projecting upwardly from the upper roof surface. The flexible sheet membrane will not peel from the upwall, for the shear strength of the adhesive is effective in resisting peeling of the membrane relative to the substrate of the roofing installation due to outside causes such as membrane shrinkage and the like.

Other objects will be in part obvious and in part pointed out in more detail hereinafter.

A better understanding of the objects, advantages, features, properties and relations of this invention will be obtained from the following detailed description and accompanying drawings which set forth a certain illustrative embodiment and is indicative of the way in which the principle of this invention is employed.

Additional objects and advantages of this invention will become more readily apparent to those skilled in the art when the following general statements and descriptions are read in the light of the appended drawings.

DETAILED DESCRIPTION

Figure 2:
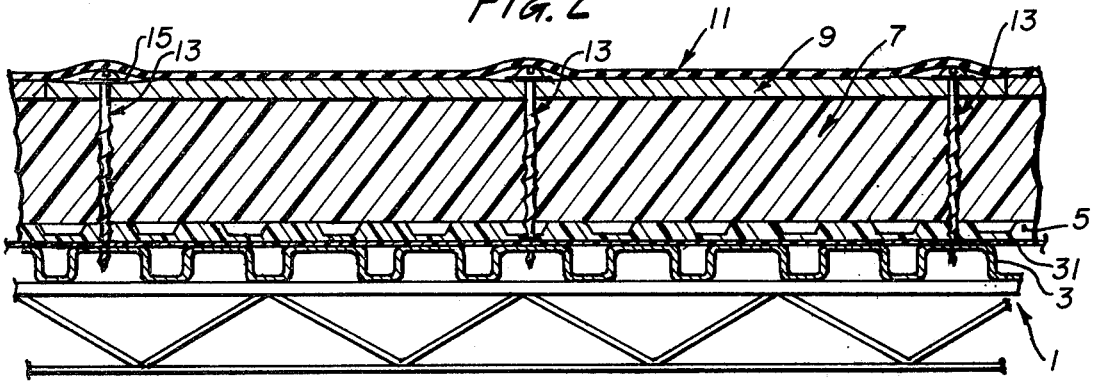
FIG. 2 is a view, partly broken away and partly in section, taken generally along line 2—2 of FIG. 1.
Figure 3:
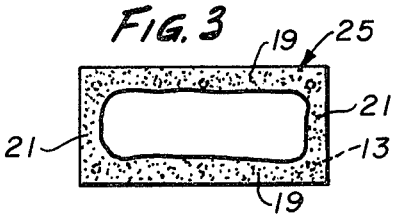
FIG. 3 is a reduced plan view showing a membrane support board following the application of adhesive to specific areas thereof.
Figure 4:
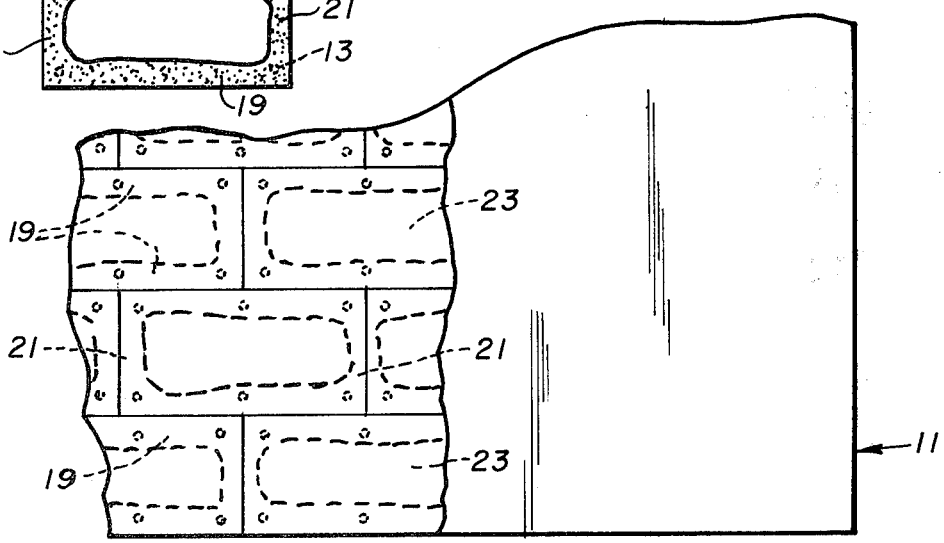
FIG. 4 is a reduced plan view of a roofing installation with parts of the flexible membrane being broken away to disclose insulation blocks with membrane support board mounted thereon.

I have illustrated a supporting joist 1 (FIG. 2) upon which is mounted a conventional metal roof deck 3. Mounted on this roof deck 3 is a fire barrier reservoir board 5 which is preferably provided and formed in accordance with the disclosure in my pending patent application Ser. No. 160,948 filed June 19, 1980. Mounted on the fire barrier reservoir board 5 are a plurality of generally rectangular blocks of insulation 7 formed of any suitable insulating material such as stryrofoam or the like which may be used to advantage in a roofing installation of this character.

Mounted on top and covering the blocks of insulation 7 is a rigid, membrane support board 9 formed of suitable composition material. The described components are secured to roof deck 3 by fastening means such as screws 13 or the like and clip plates 15, each screw 13 having a conventional screw head 17. Each screw 13 is shown extending through composite board 9, insulation block 7, the fire barrier board 5, and the metal roof deck 3 to secure the components to the deck 3. In the final operative structure a flexible sheet membrane 11 is adhered to board 9 in a uniquely specific manner as described below.

Figure 1:
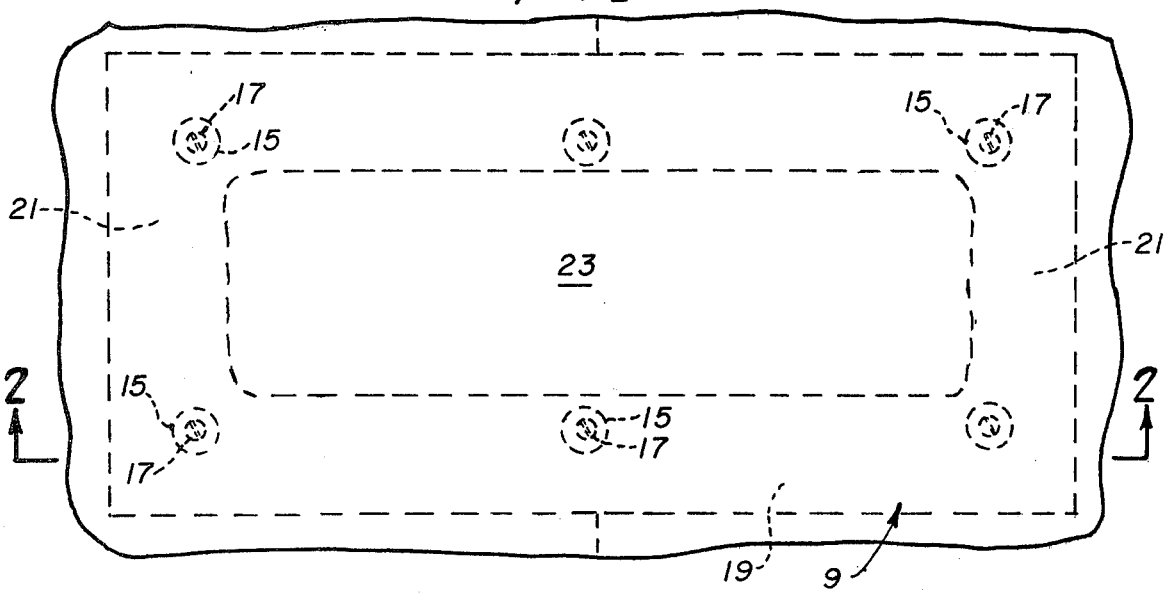
FIG. 1 is a top plan view illustrating a block of insulation having fastening means employed for securing the same to the roof deck.

FIG. 1 illustrates the insulation block 7 upon which is mounted board 9 to which the flexible membrane 11 is caused to adhere following the application of a suitable bonding contact adhesive to the board 9 in a specific pattern. It will be understood that the membrane 11 is preferably made of rubber or other suitable elastomeric material.

To provide significant cost and labor savings, the adhesive pattern is predetermined to maximize savings while also ensuring a roofing seal of high integrity which results in an installation resistant to both air and water infiltration which may otherwise tend to effect a pressure build-up below membrane 11 through joints or openings in the substrates which could cause the roofing installation to be destroyed by the membrane 11 blowing off upon reduction in the air pressure above the membrane 11, e.g., in a wind uplift vortex.

It will be recognized that by not completely covering the top surface of the board 9 with an adhesive, substantial economies will be effected due to the use of less adhesive and this constitutes a factor of substantial significance in large roofing installations particularly. I have discovered that a firm, effective and sound adherence of the flexible membrane 11 to the board 9 may be accomplished by applying adhesive in longitudinally extending marginal areas 19 of board 9 and also in transverse marginal connecting areas 21 thereof. The substantially large central area 23 of each board 9 remains free of adhesive. Thus, when the flexible membrane 11 is applied to a board 9 to which adhesive has been applied in the manner as described above, the flexible membrane will adhere to the board in its marginal areas 19 and 21 but will not be adhered to its central area 23. The area 19 and 21 to which adhesive is applied preferably should extend from the perimeter of the board 9 inwardly a distance of about 9 inches. In applying the adhesive, which is designated by numeral 25 in the drawings, a special adhesive applying roller or the like (not shown) may be employed which is designed so that no adhesive is applied to board 9 in its central area 23.

Subsequent to the application of adhesive 25 to areas 19 and 21 of board 9, with the area 23 thereof remaining uncoated with adhesive, the flexible membrane 11 is applied to the board 9 and is caused to adhere thereto in areas on the underside of membrane 11 confronting the corresponding areas 19 and 21, but not to the adhesive-free area 23. It will be understood that substrates of the roofing installation are secured as noted above to roof deck 3 by means of the screws 13 or other suitable fastening elements prior to the adhesive applying step. When blocks of insulation of approximately 4 feet by 8 feet in size are used, it has been found that six screws 13 provide satisfactory assembly of each block 7 and the other substrates to the deck 3. The screws are aligned longitudinally of board 9 and each screw 13 is utilized in the areas of the board 9 to which adhesive is to be applied to provide the adhesively sealed areas in overlying lapping relation to the adjoining perimeters of adjacent blocks 7. Each screw 13 is positioned adjacent the perimeter of its respective block and may be positioned about 6 inches inwardly from each longitudinal edge of the block with the screws 13 adjacent each transverse edge of the block (FIG. 1) also being positioned about 6 inches away from the transverse edge. The screws 13 are dimensioned to extend through board 9, the block 7 of insulation, the reservoir board 5 and into the metal roof deck 3, and it is desirable that all of the screws or other suitable fastening device have clip plates 15 associated therewith.

In practicing this invention, with the roof deck 3 having been mounted and supported on the joists 1, a suitable vapor barrier such as at 31 may be installed in overlying relation tpo deck 3, and the fire reservoir board 5 may be mounted on roof deck 3 with vapor barrier 31 interposed therebetween. The blocks 7 of insulation are then laid in abutting relation to one another upon the reservoir board 5, and board 9 is laid upon the upper surface of insulation blocks 7. To completely seal the joints between insulation blocks 7 and any holes which may be made upon fastener installation to effectively obviate undesired air infiltration and pressure build-up below membrane 11, screws 13 and clips 15 are then installed as described. I.e., each screw 13 and its associated clip 15 is installed in its respective board 9 underlying the areas thereof to which adhesive is to be applied. As noted, each such screw 13 and clip 15 is disposed approximately 6 inches inwardly from the perimeter of its insulation block 7 and is then driven into the components in order to securely fix the components to deck 3.

Figure 5:
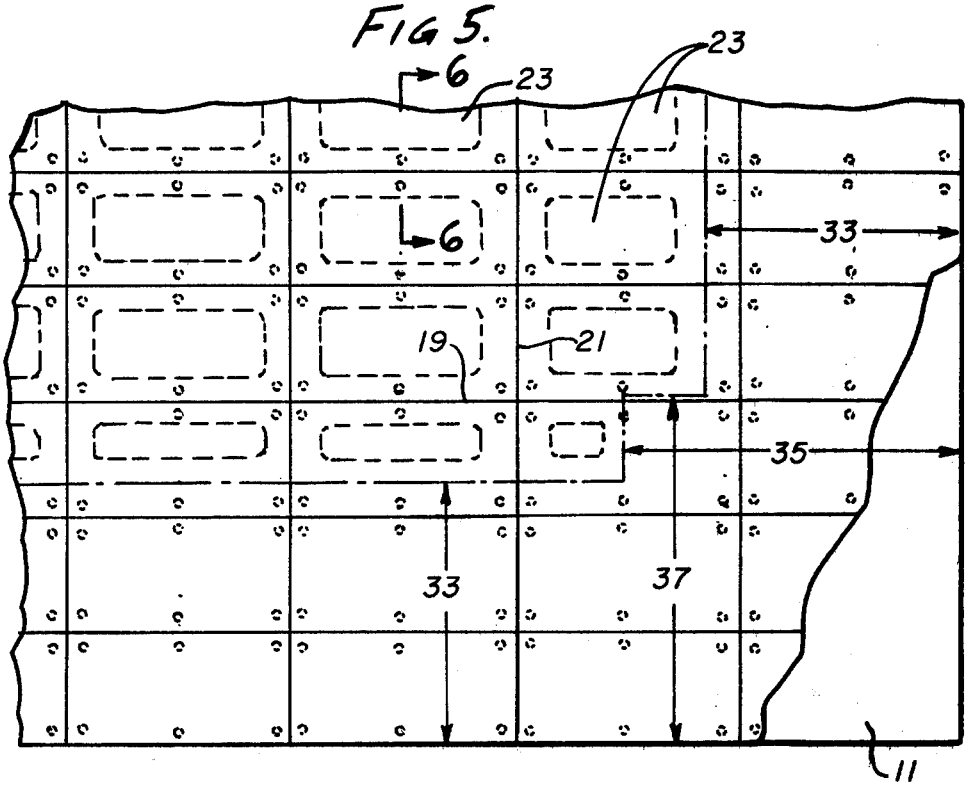
FIG. 5 is a plan view similar to that of FIG. 4 showing a squared corner of a roofing installation of this invention.
Figure 6:
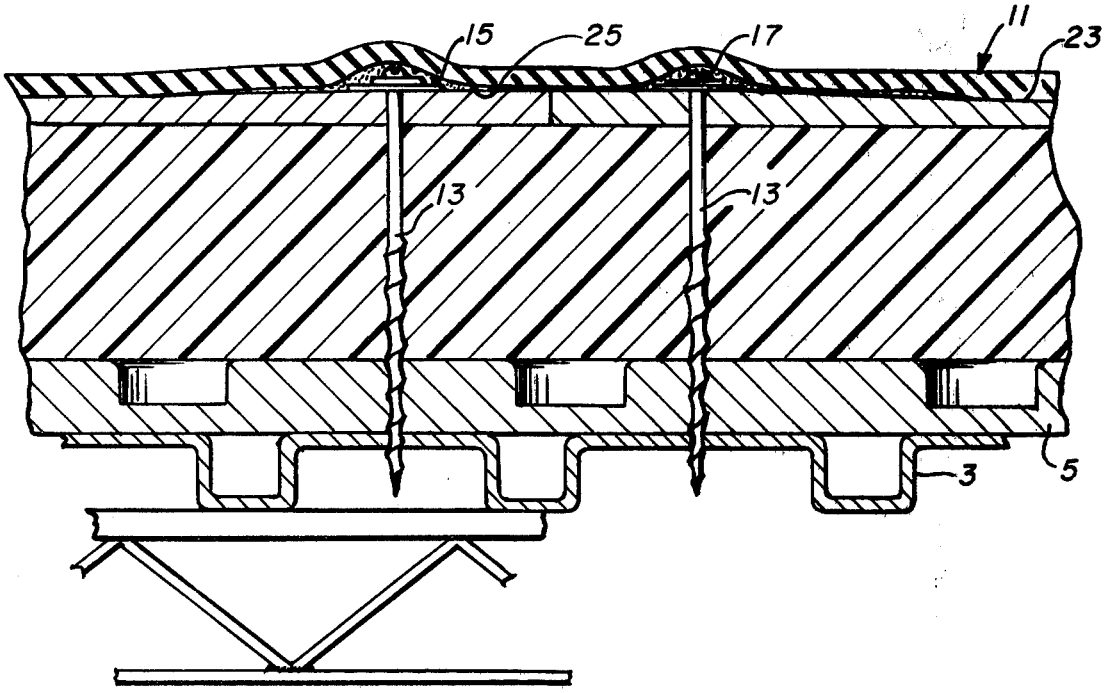
FIG. 6 is an enlarged view, partly broken away and partly in section, taken generally along line 6—6 of FIG. 5.

To maximize the sealing integrity of the roofing installation, marginal portions of the roof membrane 11 are preferably fully adhered to the underlying substrate such as board 9 for, say, a distance of about 10 feet as represented by the dimensional designations 33 in FIG. 5 between the outer roof edges and the inner edges of the fully adhered portion of membrane 11. Moreover, it has been found that in roofing installations having squared corner portions such as shown in FIG. 5, an adhesively sealed membrane area comprising about 12 feet by 12 feet (as indentified by bounding dimensional designations 35, 37) is preferably provided at each squared corner of the roof. Such construction enhances the sealing capability and integrity of the roofing installation and its resistance to undesired air and water infiltration to the roofing substrates.

By virture of the described adhesive pattern, the interior areas of the roofing installation (bordered by the disclosed fully adhered marginal seals between membrane 11 and board 9) provide interior adhesive-free zones comprising at least 50 percent of the defined interior roofing area to effect major cost and labor savings in a roof construction of high integrity effectively sealing all fastener openings and joints between adjoining insulation blocks 7.

To secure membrane 11 to board 9 in the defined interior roofing area bounded by edges 33, 35, 37 of the fully adhered outer edge membrane 11, a roller or other suitable adhesive applying means is run over the upper surface of board 9 to coat areas 19 and 21 thereof with adhesive 25, leaving central board areas 23 free of adhesive. Once this operation is completed, flexible membrane 11 is applied to the board 9 with the adhesive 25 applied thereto in the described limited, specified areas thereof and is caused to firmly adhere to these areas to complete the roofing installation while sealing all fastener openings and joints between adjoining insulation blocks 7.

As will be apparent to persons skilled in the art, various modifications, adaptations and variations of the foregoing specific disclosure can be made without departing from the teachings of the present invention.

I claim:

1. A roofing installation comprising a deck, a flexible membrane forming an upper roof surface and a plurality of substrates underlying the flexible membrane including the deck and blocks of insulation supported by the deck with each of the insulation blocks fixed relative to the deck in abutting relation to adjacent blocks of insulation, the substrate which is in direct underlying relation to the flexible membrane having a plurality of discrete abutting members, and adhesive means between the flexible membrane and said directly underlying substrate for securing the same, the adhesive means being applied in a predetermined pattern wherein the adhesive means covers and adheres preselected confronting areas of the flexible membrane and said directly underlying substrate in sealed engagement to provide adhesively sealed areas of high integrity between the flexible membrane and said directly underlying substrate, the adhesively sealed areas being in overlying, lapping relation to abutting perimeters of the substrate directly underlying the flexible membrane, the pattern of the adhesive means additionally providing selected adhesive-free zones between the flexible membrane and said directly underlying substrate completely free of the adhesive means.

2. The roofing installation of claim 1 wherein the adhesively sealed areas are in overlying, lapping relation to perimeters of the insulation blocks.

3. The roofing installation of claim 2 wherein said adhesive-free zones overlie interior areas of selected insulation blocks.

4. The roofing installation of claim 3 wherein a plurality of fastening means are provided for each insulation block in underlying relation to said adhesively sealed areas with each of the fastening means positioned adjacent the perimeter of its respective block in spaced apart relation to adjacent fastening means thereof.

5. The roofing installation of claim 1 further including fastening means positioned adjacent the perimeter of each insulation block for securing the same to the deck, the adhesively sealed areas being in overlying, lapping relation to the perimeters of the insulation blocks and their respective fastening means to provide a roofing seal of high integrity in overlying relation to adjoining blocks and their fastening means.

6. The roofing installation of claim 1 wherein the adhesively sealed areas include marginal portions of the roofing installation extending a distance of about 10 feet inwardly from its outer edges thereby providing a fully adhered marginal seal of high integrity between the flexible membrane and its underlying substrate.

7. The roofing installation of claim 6 wherein the pattern of the adhesive means defines an interior roofing area of the roofing installation bordered by the fully adhered marginal seal, the interior roofing area having adhesive-free zones comprising at least about 50 percent of said interior roofing area.

8. The roofing installation of claim 1 wherein the installation includes squared corner portions, and wherein the adhesively sealed areas include an area of about 12 feet by 12 feet at each such squared corner portion of the roofing installation.

9. The roofing installation of claim 1 further including vapor barrier means underlying the insulation blocks and overlying the roof deck.

10. The roofing installation of claim 1 wherein the substrates further include a membrane support board interposed between the flexible membrane and the underlying insulation blocks, the adhesive means being applied to an upper surface of the membrane support board and a confronting underside of the flexible membrane in said predetermined adhesive pattern.

11. The roofing installation of claim 1 wherein the substrates further include a fire barrier board supported on the roof deck in underlying relation to the insulation blocks, and a membrane support board supported on the insulation blocks between the insulation blocks and the flexible membrane, and fastening means for securing the membrane support board and the insulation blocks and fire barrier board to the roof deck, the fastening means being positioned adjacent the perimeter of each insulation block, the adhesively sealed areas providing a roofing seal of high integrity in overlying relation to the abutting perimeters of the membrane support board.

12. The roofing installation of claim 1 wherein the fully adhered marginal portions of the roofing installation extend a distance of at least about 10 feet inwardly from its outer edges.

13. A method of adhesively securing a flexible membrane to a roofing installation consisting of substrates including a roof deck and blocks of insulation mounted on the roof deck and comprising the steps of fastening the substrates of the roofing installation to the deck, applying adhesive to predetermined areas of the substrate directly underlying the flexible membrane while leaving selected zones of the directly underlying substrate free of adhesive, the adhesive applying step providing adhesive in overlying lapping relation to abutting edges of the directly underlying substrate, applying the flexible membrane to said directly underlying substrate of the roofing installation and causing said flexible membrane to adhere to the predetermined areas of said directly underlying substrate of the roofing installation to which adhesive has been applied.

14. A method of adhesively securing a flexible membrane to a roofing installation consisting of substrates including a roof deck, blocks of insulation mounted on the roof deck and a membrane support board in overlying relation to the insulation blocks, the method comprising the steps of fastening the substrates of the roofing installation to the deck, applying adhesive to predetermined areas of the membrane support board underlying the flexible membrane in selected areas extending inwardly a predetermined distance from the perimeter of selected underlying insulation blocks while leaving a central zone of the membrane support board free of adhesive, applying the flexible membrane to said membrane support board and causing said flexible membrane to adhere to the predetermined areas of said support board to which adhesive has been applied.

15. A method of adhesively securing a flexible membrane to a roofing installation consisting of substrates including a roof deck and blocks of insulation mounted on the roof deck and comprising the steps of fastening the substrates of the roofing installation to the deck, applying adhesive to predetermined areas of the substrate underlying the flexible membrane to provide adhesively sealed areas between the membrane and its underlying substrate in overlying, lapping relation to perimeters of the insulation blocks and to provide adhesive-free zones overlying interior areas of selected insulation blocks, applying the flexible membrane to said underlying substrate of the roofing installation and causing said flexible membrane to adhere to the predetermined areas of said underlying substrate of the roofing installation to which adhesive has been applied.

16. A method of adhesively securing a flexible membrane to a roofing installation consisting of substrates including a roof deck and blocks of insulation mounted on the roof deck and comprising the steps of fastening the subtrates of the roofing installation to the deck, applying adhesive to predetermined areas of the substrate underlying the flexible membrane while leaving selected zones of the substrate free of adhesive, additionally applying adhesive to the substrate underlying the flexible membrane throughout the marginal portions of the roofinfg installation adjacent outer edges thereof, applying the flexible membrane to said underlying substrate of the roofing installation and causing said flexible membrane to adhere to the predetermined areas of said underlying substrate of the roofing installation to which adhesive has been applied for providing a fully adhered marginal seal of high integrity upon applying the flexible membrane to said underlying substrate throughout marginal portions of the roofing installation adjacent outer edges thereof.

17. A method of adhesively securing a flexible membrane to a roofing installation consisting of substrates including a roof deck and blocks of insulation mounted on the roof deck and comprising the steps of fastening the substrates of the roofing installation to the deck, installing mechanical fasteners adjacent perimeters of the insulation blocks to secure the same to the roof deck, and thereafter applying adhesive to predetermined areas of the substrate underlying the flexible membrane and overlying joints between blocks of insulation and openings formed during said mechanical fastener installing step while leaving selected zones of the substrate free of adhesive, applying the flexible membrane to said underlying substrate of the roofing installation and causing said flexible membrane to adhere to the predetermined areas of said underlying substrate of the roofing installation to which adhesive has been applied.

* * * * *